US005947833A

United States Patent [19]

Alward

[11] Patent Number: 5,947,833

[45] Date of Patent: Sep. 7, 1999

[54] FOOT POSITION TEACHING APPARATUS FOR BATTING PRACTICE

[76] Inventor: Christopher T. L. Alward, 20 House Ave., Brantford, Canada, N3R 4G6

[21] Appl. No.: 08/842,906

[22] Filed: Apr. 17, 1997

[51] Int. Cl.[6] ..... A63B 69/00

[52] U.S. Cl. ..... 473/218; 473/452

[58] Field of Search ..... 473/452, 218

[56] References Cited

U.S. PATENT DOCUMENTS

| | | | |
|---|---|---|---|
| 3,342,487 | 9/1967 | David | 473/452 |
| 3,815,906 | 6/1974 | Hermo | 473/452 |
| 4,194,735 | 3/1980 | Wilson | 473/452 |
| 5,076,580 | 12/1991 | Lang | 473/452 |
| 5,330,176 | 7/1994 | Cagney | 473/452 |

*Primary Examiner*—Jeanette Chapman
*Assistant Examiner*—Stephen L. Blau

[57] ABSTRACT

A new Foot Position Teaching Apparatus for Batting Practice for assisting in the education of an individual for an effective batting stance for baseball or softball. The inventive device includes a stance mat having a batters box border and a feet separating line, and a plate mat connectable to the stance mat having a home plate indicia. The inventive device alternatively includes a left and a right foot placement indicia on opposing sides of the feet separating line which is traverse to ball projectory from a pitcher.

9 Claims, 4 Drawing Sheets

10
20
24
28
22
12

10
20
4
4
3

FOOT POSITION TEACHING APPARATUS FOR BATTING PRACTICE

BACKGROUND OF THE INVENTION

1. Field of the Invention

The present invention relates to Batting Devices and more particularly pertains to a new Foot Position Teaching Apparatus for Batting Practice for assisting in the education of an individual for an effective batting stance for baseball or softball.

2. Description of the Prior Art

The use of Batting Devices is known in the prior art. More specifically, Batting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Batting Devices include U.S. Pat. No. 4,463,950; U.S. Pat. No. 4,194,735; U.S. Pat. No. 3,979,116; U.S. Design Pat. No. 355,459; U.S. Pat. No. 5,330,176 and U.S. Pat. No. 5,076,580.

While these devices fulfill their respective, particular objectives and requirements, the aforementioned patents do not disclose a new Foot Position Teaching Apparatus for Batting Practice. The inventive device includes a stance mat having a batters box border and a feet separating line, and a plate mat connectable to the stance mat having a home plate indicia.

In these respects, the Foot Position Teaching Apparatus for Batting Practice according to the present invention substantially departs from the conventional concepts and designs of the prior art, and in so doing provides an apparatus primarily developed for the purpose of assisting in the education of an individual for an effective batting stance for baseball or softball.

SUMMARY OF THE INVENTION

In view of the foregoing disadvantages inherent in the known types of Batting Devices now present in the prior art, the present invention provides a new Foot Position Teaching Apparatus for Batting Practice construction wherein the same can be utilized for assisting in the education of an individual for an effective batting stance for baseball or softball.

The general purpose of the present invention, which will be described subsequently in greater detail, is to provide a new Foot Position Teaching Apparatus for Batting Practice apparatus and method which has many of the advantages of the Batting, Devices mentioned heretofore and many novel features that result in a new Foot Position Teaching Apparatus for Batting Practice which is not anticipated, rendered obvious, suggested, or even implied by any of the prior art Batting Devices, either alone or in any combination thereof.

To attain this, the present invention generally comprises a stance mat having a batters box border and a feet separating line, and a plate mat connectable to the stance mat having a home plate indicia.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Foot Position Teaching Apparatus for Batting Practice apparatus and method which has many of the advantages of the Batting Devices mentioned heretofore and many novel features that result in a new Foot Position Teaching Apparatus for Batting Practice which is not anticipated, rendered obvious, suggested, or even implied by any of the prior art Batting Devices, either alone or in any combination thereof.

It is another object of the present invention to provide a new Foot Position Teaching Apparatus for Batting Practice which may be easily and efficiently manufactured and marketed.

It is a further object of the present invention to provide a new Foot Position Teaching Apparatus for Batting Practice which is of a durable and reliable construction.

An even further object of the present invention is to provide a new Foot Position Teaching Apparatus for Batting Practice which is susceptible of a low cost of manufacture with regard to both materials and labor, and which accordingly is then susceptible of low prices of sale to the consuming public, thereby making such Foot Position Teaching Apparatus for Batting Practice economically available to the buying public.

Still yet another object of the present invention is to provide a new Foot Position Teaching Apparatus for Batting Practice which provides in the apparatuses and methods of the prior art some of the advantages thereof, while simultaneously overcoming some of the disadvantages normally associated therewith.

Still another object of the present invention is to provide a new Foot Position Teaching Apparatus for Batting Practice for assisting in the education of an individual for an effective batting stance for baseball or softball.

Yet another object of the present invention is to provide a new Foot Position Teaching Apparatus for Batting Practice which includes a stance mat having a batters box border and a feet separating line, and a plate mat connectable to the stance mat having a home plate indicia.

Still yet another object of the present invention is to provide a new Foot Position Teaching Apparatus for Batting Practice that assures body positioning with respect to home plate for providing consistently sold hits.

Even still another object of the present invention is to provide a new Foot Position Teaching Apparatus for Batting Practice that assists in rapid skill improvement and increased self confidence in young players of baseball or softball.

These together with other objects of the invention, along with the various features of novelty which characterize the invention, are pointed out with particularity in the claims annexed to and forming(g a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein.

DESCRIPTION OF THE PREFERRED EMBODIMENT

Figure 1:
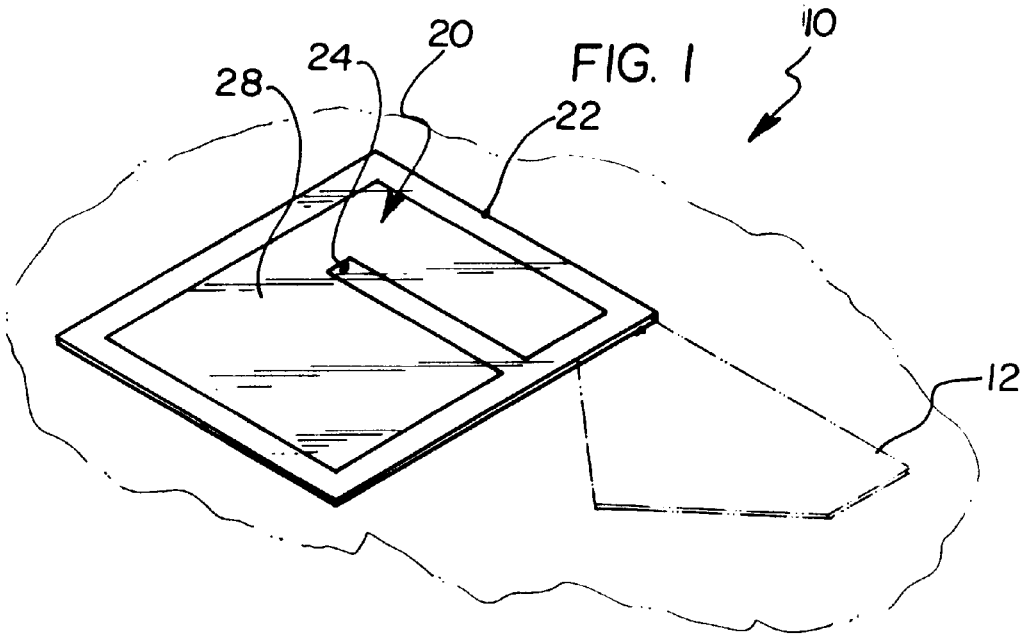
FIG. 1 is an upper perspective view of a new Foot Position Teaching Apparatus for Batting Practice according to the present invention.
Figure 2:
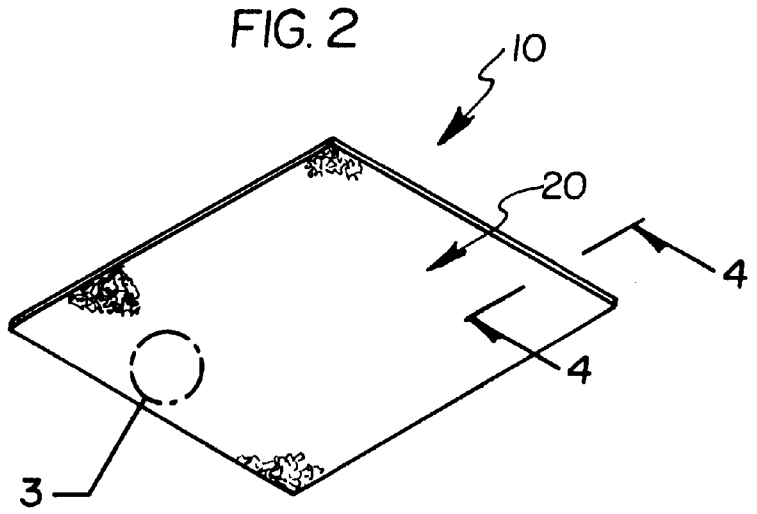
FIG. 2 is a lower perspective view of the present invention.
Figure 3:
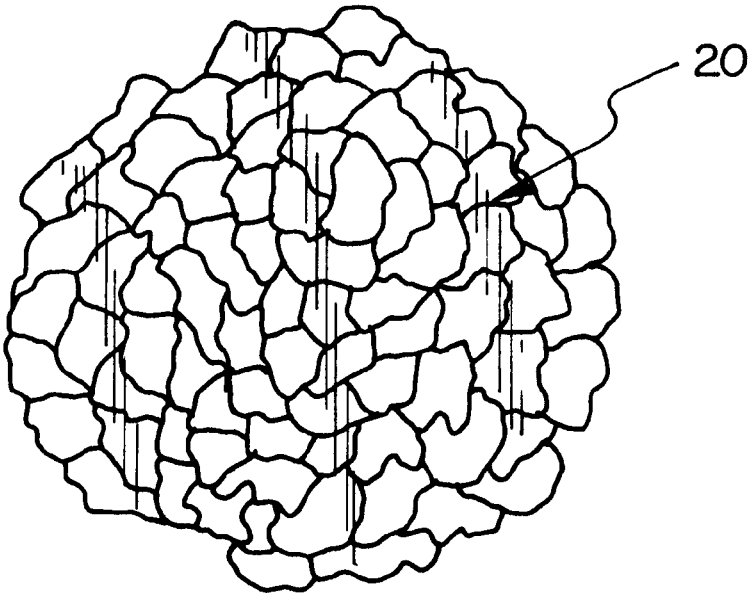
FIG. 3 is a magnified view from FIG. 2 disclosing the recycled rubber.

With reference now to the drawings, and in particular to FIGS. 1 through 8 thereof, a new Foot Position Teaching Apparatus for Batting Practice embodying the principles and concepts of the present invention and generally designated by the reference numeral 10 will be described.

More specifically, it will be noted that the Foot Position Teaching Apparatus for Batting Practice 10 comprises a stance mat 20 having a batters box border 22 and a feet separating line 24, and a plate mat 30 connectable to the stance mat 20 having a home plate 12 indicia.

Figure 4:
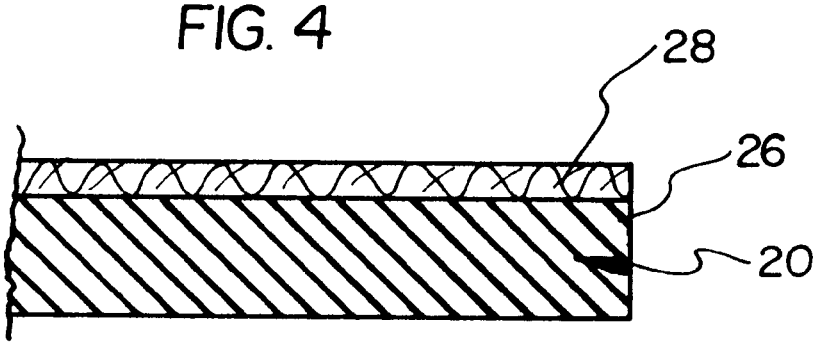
FIG. 4 is a cross sectional view taken along line 4—4 of FIG. 2.
Figure 6:
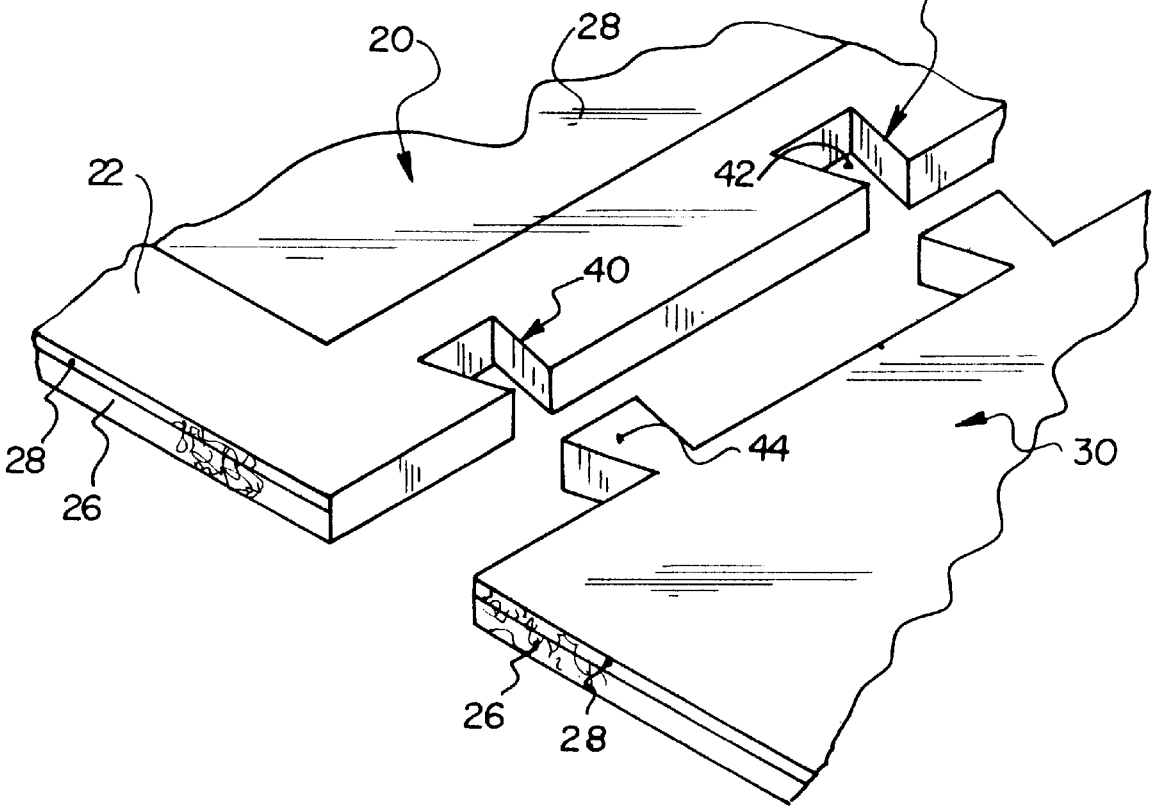
FIG. 6 is a magnified upper perspective view of the alternative embodiment.

As shown in FIGS. 4 and 6, the stance mat 20 is preferably constructed of a layer of recycled rubber 28 and a cover layer 26 secured to the recycled rubber 28 wherein the stance mat 20 has an inner edge which is positionable adjacent a home plate 12. The batters box border 22 is secured to an outer perimeter of the cover layer 26 as best shown in FIG. 1 of the drawings. The feet separating line 24 is secured to a concentric portion of the batters box border 22 adjacent the inner edge of the stance mat 20 and extends a finite distance away from the home plate 12 traversely to an axis mesial the home plate 12 and a pitchers mound for separating a user's feet as shown in FIG. 1 of the drawings. The feet separating line 24 forms a left zone and a right zone for the user's feet.

Figure 5:
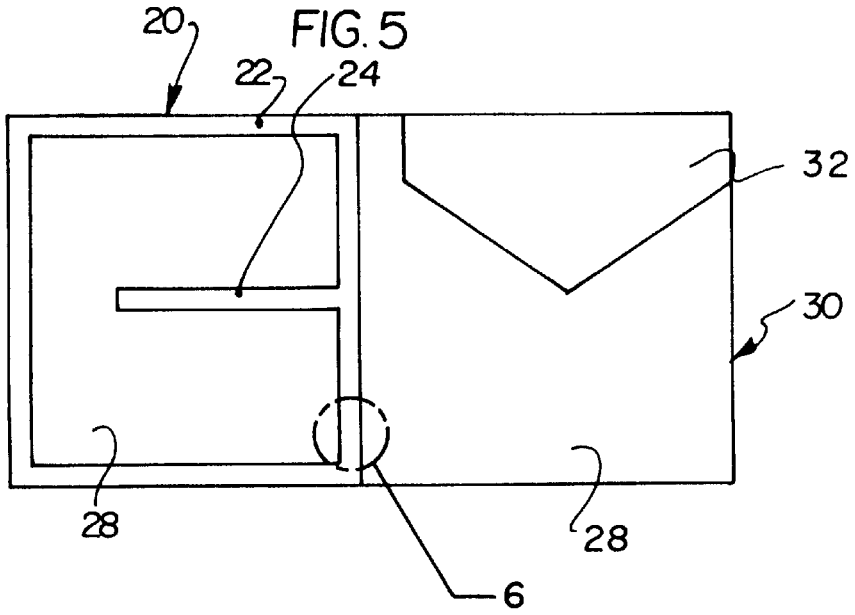
FIG. 5 is a top view of an alternative embodiment.

In a first alternative embodiment as shown in FIGS. 5 and 6, a plate mat 30 has a plate indicia 32 adjacent a rear edge representing the home plate 12. A connecting means 40 is provided for removably attaching the plate mat 30 to the inner edge of the plate mat 30 wherein the inner edge is orthogonal to the rear edge of the plate mat 30 as best shown in FIG. 6 of the drawings. The connecting means 40 comprises a plurality of triangular notches 42 projecting into the inner edge of the stance mat 20. A corresponding plurality of triangular members 44 secured to an edge of the plate mat 30 orthogonal to the rear edge as shown in FIG. 6 of the drawings. The triangular members 44 snugly projects within the triangular notches 42 to form what is sometimes referred to as a "dove tail joint". The plate mat 30 is preferably constructed from a layer of recycled rubber 28 and a cover layer 26 secured to the recycled rubber 28 as shown in FIG. 6 of the drawings.

Figure 7:
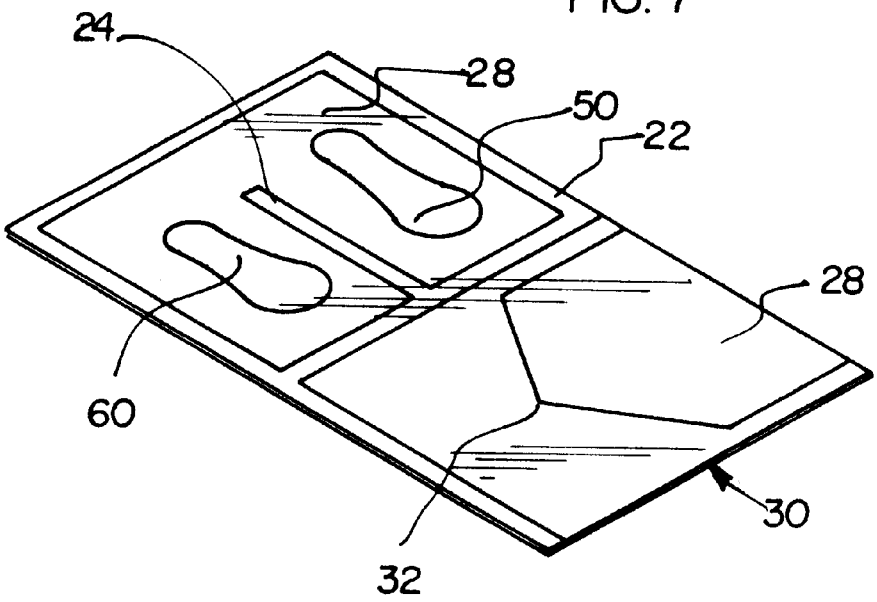
FIG. 7 is an upper perspective view of a second alternative embodiment including a pair of foot placement indicia.
Figure 8:
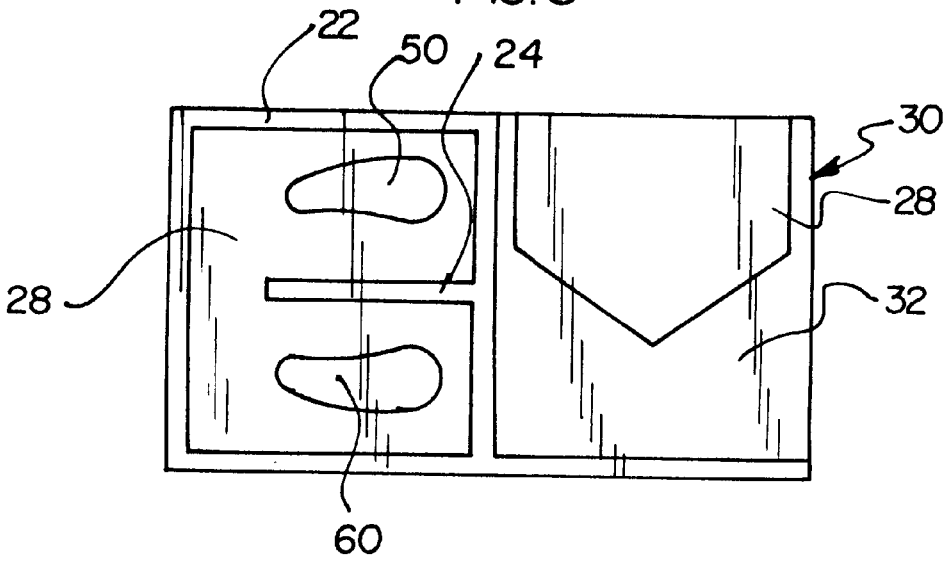
FIG. 8 is a top view of the second alternative embodiment of the present invention.

In a second alternative embodiment as shown in FIGS. 7 and 8, a left foot placement indicia 50 is secured to the left zone of the cover layer 26. The left foot placement indicia 50 indicates where the user should position their left foot during their batting stance. A right foot placement indicia 60 is secured to the right zone of the cover layer 26, wherein the right foot placement indicia 60 indicates where the user should position their right foot during a batting stance.

In use, the stance malt 20 is positioned adjacent the home plate 12. The user position's their left foot upon the left foot placement indicia 50 and their right foot upon the right foot placement indicia 60. This stance squares the batter properly with respect to home plate 12 and the path of the ball during a pitch. This stance also provides consistent solid hits during batting compared to various other stances.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot position teaching apparatus for batting practice comprising:

a stance mat comprised of a layer of recycled rubber and a cover layer secured to said layer of recycled rubber, wherein said stance mat has an inner edge which is positionable adjacent a home plate;

a batters box border located along an outer perimeter of said cover layer; and a feet guiding line having a first end, wherein said first end is positioned adjacent to a portion of said batters box border located adjacent said inner edge of said stance mat, said feet guiding line extending perpendicularly with respect to said inner edge of said stance mat for a finite distance away from said portion of said batters box border for being positioned between a user's feet when said user stands on said stance mat, wherein said feet guiding line forms a left zone and a right zone on said stance mat for said user's feet.

2. The foot position teaching apparatus for batting practice of claim 1, including a plate mat having a plate indicia representing said home plate, wherein said plate indicia is positioned adjacent to a rear edge of said plate mat.

3. The foot position teaching apparatus for batting practice of claim 2, including a connecting means for removably attaching said plate mat to said inner edge of said stance mat, and wherein said inner edge is positioned orthogonal to said rear edge of said plate mat.

4. A foot position teaching apparatus for batting practice comprising:

a stance mat comprised of a layer of recycled rubber and a cover layer secured to said layer of recycled rubber, wherein said stance mat has an inner edge which is positionable adjacent a home plate;

a batters box border secured to an outer perimeter of said cover layer; and a feet guiding line having a first end, wherein said first end is positioned adjacent to a portion of said batters box border located adjacent said inner edge of said stance mat, said feet guiding line extending perpendicularly with respect to said inner edge of said stance mat for a finite distance away from said portion of said batters box border for being positioned between a user's feet when said user stands on said stance mat, wherein said feet guiding line forms a left zone and a right zone on said stance mat for said user's feet;

a plate mat having a plate indicia representing said home plate, wherein said plate indicia is positioned adjacent a rear edge of said plate mat;

a connecting means for removably attaching said plate mat to said inner edge of said stance mat, and wherein said inner edge is positioned orthogonal to said rear edge of said plate mat and;

said connecting means including a plurality of dove-tail joints.

5. The foot position teaching apparatus for batting of claim 4, including:

a left foot placement indicia secured to said left zone of said cover layer; and a right foot placement indicia secured to said right zone of said cover layer.

6. The foot position teaching apparatus for batting practice of claim 5, wherein said plate mat comprises a layer of recycled rubber and a cover layer secured to said recycled rubber.

7. A foot position teaching apparatus for teaching and practicing proper foot positioning for attempting to hit a baseball as a user would do while playing a baseball game, the teaching apparatus comprising:

a stance mat having a plate-side edge;

a border demarcation on a top surface of said stance mat, said border being shaped to correspond to the shape of a baseball batter's box;

a guiding line extending inwardly a finite distance away from said plate side edge, said guiding line being substantially perpendicular to said plate-side edge, wherein said feet guiding line forms a left zone and a right zone;

a plate mat having a plate indicia representing a home plate;

a connecting means for removably attaching said plate mat to said plate-side edge of said stance mat and;

said connecting means including a plurality of dove-tail joints.

8. A foot position teaching apparatus as in claim 7, wherein said stance mat includes a left foot position indicator within said left zone and a right fool position indicator within said right zone.

9. A foot position teaching apparatus as in claim 7, wherein said plate indicia is positioned proximate a rearward edge of said plate mat.

* * * * *